US009470046B2

(12) United States Patent
Armistead

(10) Patent No.: US 9,470,046 B2
(45) Date of Patent: Oct. 18, 2016

(54) CURVED CASING PIPE WITH TIMED CONNECTIONS

(71) Applicant: George Taylor Armistead, Katy, TX (US)

(72) Inventor: George Taylor Armistead, Katy, TX (US)

(73) Assignee: CHEVRON U.S.A. INC., San Ramon, CA (US)

( * ) Notice: Subject to any disclaimer, the term of this patent is extended or adjusted under 35 U.S.C. 154(b) by 642 days.

(21) Appl. No.: 13/778,341

(22) Filed: Feb. 27, 2013

(65) Prior Publication Data

US 2014/0238690 A1 Aug. 28, 2014

(51) Int. Cl.
*E21B 17/08* (2006.01)
*E21B 43/10* (2006.01)

(52) U.S. Cl.
CPC ..... *E21B 17/08* (2013.01)

(58) Field of Classification Search
CPC ... E21B 17/08; E21B 17/042; E21B 17/0423
See application file for complete search history.

(56) References Cited

U.S. PATENT DOCUMENTS 4,519,463 A * 5/1985 Schuh ..... E21B 43/305 166/50
4,653,598 A * 3/1987 Schuh ..... E21B 17/16 175/325.2
4,732,416 A * 3/1988 Dearden ..... F16L 15/004 285/333
4,901,793 A * 2/1990 Weber ..... E21B 23/01 166/210
5,135,059 A * 8/1992 Turner ..... E21B 4/02 175/101
5,346,016 A * 9/1994 Wilson ..... E21B 17/1014 166/212
6,009,947 A * 1/2000 Wilson ..... E21B 43/11 166/100
6,123,368 A * 9/2000 Enderle ..... E21B 17/0423 285/334
6,202,752 B1 * 3/2001 Kuck ..... E21B 7/061 166/298
2004/0123984 A1 * 7/2004 Vail, III ..... E21B 7/065 166/291
2005/0092499 A1 * 5/2005 Hall ..... E21B 17/003 166/380
2005/0242583 A1 * 11/2005 Geary ..... E21B 17/042 285/333
2006/0125234 A1 * 6/2006 Ernst ..... E21B 17/042 285/333
2012/0235406 A1 * 9/2012 Sugino ..... F16L 15/001 285/390
2013/0300112 A1 * 11/2013 Shand ..... E21B 17/042 285/355
2014/0110098 A1 * 4/2014 Mitchell ..... E21B 43/10 166/54

* cited by examiner

*Primary Examiner* — Benjamin Fiorello
(74) *Attorney, Agent, or Firm* — King & Spalding LLP

(57) ABSTRACT

A casing pipe assembly can include a first casing pipe having a top coupling member and a pipe curvature, where the top coupling member has first threads in a first direction, and where the pipe curvature substantially corresponds to a wellbore curvature. The casing pipe assembly can also include a second casing pipe having a bottom coupling member and substantially the same pipe curvature, where the bottom coupling member has second threads in a second direction. The casing pipe assembly can further include a coupling device having a bottom coupling member and a top coupling member, where the bottom coupling member has third threads in the first direction that threadably couple to the first threads of the first casing pipe, and where the top coupling member has fourth threads in the second direction that threadably couple to the second threads of the second casing pipe.

19 Claims, 5 Drawing Sheets

CURVED CASING PIPE WITH TIMED CONNECTIONS

TECHNICAL FIELD

The present disclosure relates generally to setting casing pipe within a subterranean wellbore.

BACKGROUND

Casing pipe is used to protect a device and/or set a boundary in a wellbore that has been drilled or otherwise created in a subterranean formation. An example of casing pipe used for protection is when electric cables (e.g., power cables, fiber optic cables) are run underground through the wellbore. In such a case, the casing pipe acts as a conduit for the cables. Another example of casing pipe used for protection is when pipes (e.g., water lines, gas lines) are run underground through the wellbore. In such a case, the casing pipe acts as a protective casing for the pipes. An example of casing pipe used as a boundary is when the wellbore is being prepared for extraction of one or more materials (e.g., oil, natural gas, water, steam) from the subterranean formation.

A majority of wellbores that are created in subterranean formations have some degree of curvature along one or more portions of the wellbore. In some cases, the wellbore (or a portion thereof) has a curvature that is too severe for casing pipe to be run into the wellbore. Specifically, when the curvature of the wellbore is too great, the side load that the walls of the wellbore apply to the casing pipe is so high that the casing pipe cannot be run into the wellbore. In such a case, so much torque and drag can be created by the side walls of the wellbore on the casing pipe that the casing pipe can become stuck in the wellbore at a point above where the casing pipe is targeted to be placed in the wellbore.

SUMMARY

In general, in one aspect, the disclosure relates to a casing pipe assembly. The casing pipe assembly can include a first casing pipe having a first body and a first top coupling member disposed on a top end of the first body, where the first body has a pipe curvature, where the first top coupling member comprises first threads oriented in a first direction, and where the pipe curvature substantially corresponds to a wellbore curvature of a portion of a wellbore in a subterranean formation. The casing pipe assembly can also include a second casing pipe having a second body and a first bottom coupling member disposed on a bottom end of the second body, where the second body has substantially the pipe curvature, and where the first bottom coupling member comprises second threads oriented in a second direction. The casing pipe assembly can further include a first coupling device having a bottom end and a top end, where the bottom end of the first coupling device comprises third threads oriented in the first direction and that threadably couple to the first threads of the first top coupling member of the first casing pipe, and where the top end of the first coupling device comprises fourth threads oriented in the second direction and that threadably couple to the second threads of the first bottom coupling member of the second casing pipe.

In another aspect, the disclosure can generally relate to a field system. The field system can include a wellbore disposed in a subterranean formation, where the wellbore has a wellbore curvature. The field system can also include a first casing pipe having a top coupling member and a pipe curvature, where the top coupling member of the first casing pipe comprises first threads oriented in a first direction, and where the pipe curvature substantially corresponds to a wellbore curvature of a portion of a wellbore in a subterranean formation. The field system can further include a first clamping device that mechanically and removably couples to the first casing pipe while a portion of the first casing pipe is disposed within the wellbore and a remainder of the first casing pipe is disposed outside the wellbore. The field system can also include a second casing pipe having a bottom coupling member and substantially the pipe curvature, where the bottom coupling member of the second casing pipe comprises second threads oriented in a second direction. The field system can further include a second clamping device that mechanically and removably couples to the second casing pipe while the second casing pipe is disposed outside the wellbore. The field system can also include a coupling device having a bottom coupling member and a top coupling member, where the bottom coupling member of the coupling device comprises third threads oriented in the first direction and that threadably couple to the first threads of the top coupling member of the first casing pipe, and where the top coupling member of the coupling device comprises fourth threads oriented in the second direction and that threadably couple to the second threads of the bottom coupling member of the second casing pipe. The field system can further include a tong that mechanically and removably couples to the coupling device, where the tong axially rotates the coupling device.

In yet another aspect, the disclosure can generally relate to a method for setting casing pipe. The method can include determining a wellbore curvature of a portion of a wellbore in a subterranean formation. In certain embodiments, the wellbore curvature is at least 2°. In certain example embodiments, the wellbore curvature is at least 3°. The method can also include bending a first casing pipe and a second casing pipe to give the first casing pipe and the second casing pipe a pipe curvature that is substantially similar to the wellbore curvature. The method can further include coupling a top coupling member of the first casing pipe to a bottom coupling member of the second casing pipe using a coupling device to form a casing pipe segment, where the casing pipe segment has a curvature that is substantially similar to and aligns with the wellbore curvature. The method can also include inserting the casing pipe segment into the wellbore.

These and other aspects, objects, features, and embodiments will be apparent from the following description and the appended claims.

BRIEF DESCRIPTION OF THE DRAWINGS

The drawings illustrate only example embodiments of curved (also called herein "bent") casing pipe with timed connections and are therefore not to be considered limiting of its scope, as curved casing pipe with timed connections may admit to other equally effective embodiments. The elements and features shown in the drawings are not necessarily to scale, emphasis instead being placed upon clearly illustrating the principles of the example embodiments. Additionally, certain dimensions or positionings may be exaggerated to help visually convey such principles. In the drawings, reference numerals designate like or corresponding, but not necessarily identical, elements.

DETAILED DESCRIPTION OF EXAMPLE EMBODIMENTS

Figure 1:
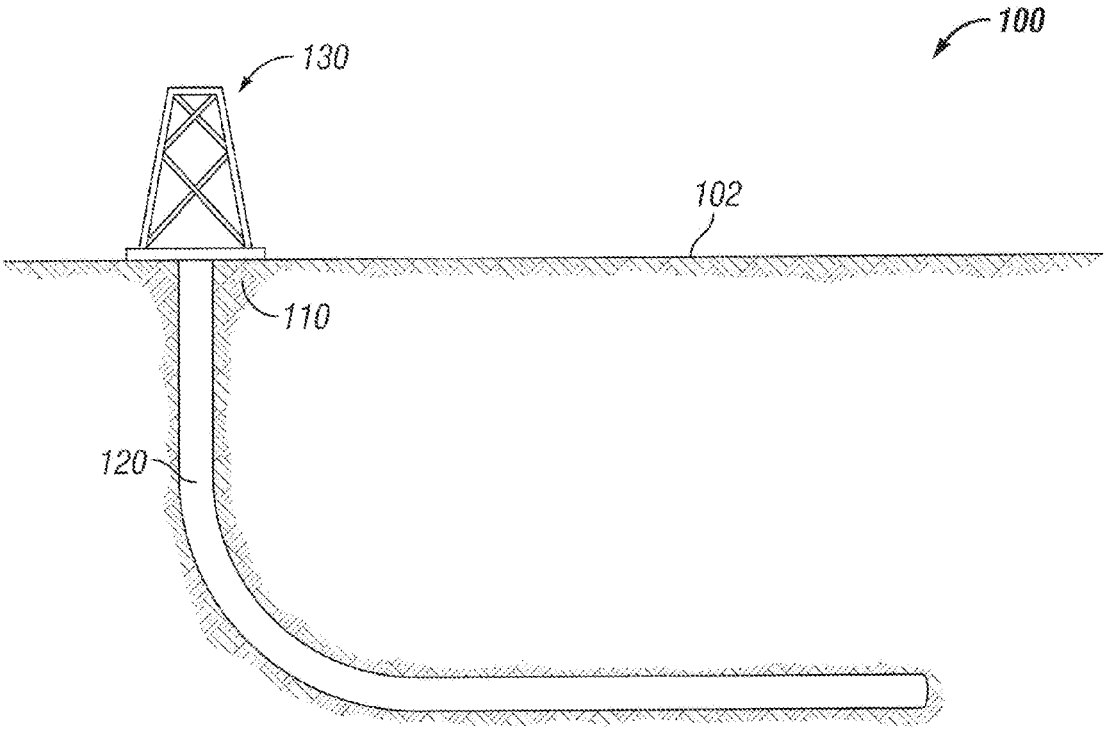
FIG. 1 shows a schematic diagram of a field system that can use example bent casing pipe in accordance with one or more example embodiments.

Example embodiments of setting casing pipe within a subterranean wellbore will now be described in detail with reference to the accompanying figures. Like, but not necessarily the same or identical, elements in the various figures are denoted by like reference numerals for consistency. In the following detailed description of the example embodiments, numerous specific details are set forth in order to provide a more thorough understanding of the disclosure herein. However, it will be apparent to one of ordinary skill in the art that the example embodiments herein may be practiced without these specific details. In other instances, well-known features have not been described in detail to avoid unnecessarily complicating the description. As used herein, a length, a width, and a height can each generally be described as lateral directions.

While couplings between casing pipes and coupling devices are described herein as using threads (mating threads), other coupling methods can also be used in certain example embodiments for timed connections. Examples of other coupling methods can include, but are not limited to, compression fittings, clamps, slots, tabs, and twist-lock connections. In any case, such coupling methods can be used without rotating a casing pipe.

Further, when threads are described herein as running in a certain direction, the threads are oriented in a certain direction. Threads that are oriented in the same direction can be mated to each other when one or both of the threads (or the devices on which the threads are disposed) are rotated in the direction in which the threads are oriented.

A user as described herein may be any person that interacts with curved casing pipe using timed connections for a field system. Examples of a user may include, but are not limited to, a roughneck, a company representative, a drilling engineer, a tool pusher, a service hand, a mechanic, an operator, a consultant, a contractor, and a manufacturer's representative.

FIG. 1 shows a schematic diagram of a field system 100 that can use example bent casing pipe with timed connections in accordance with one or more example embodiments. In one or more embodiments, one or more of the features shown in FIG. 1 may be omitted, added, repeated, and/or substituted. Accordingly, embodiments of a field system should not be considered limited to the specific arrangements of components shown in FIG. 1.

Referring now to FIG. 1, the field system 100 in this example includes a wellbore 120 that is formed in a subterranean formation 110 using field equipment 130 above a surface 102, such as ground level for an on-shore application and the sea floor for an off-shore application. The subterranean formation 110 can include one or more of a number of formation types, including but not limited to shale formations, clay formations, sand formations, and salt formations. In certain embodiments, a subterranean formation 110 can also include one or more reservoirs in which one or more resources (e.g., oil, gas, water, steam) can be located. A field operation (e.g., drilling) can be performed to extract such resources through the wellbore 120.

The wellbore 120 can have one or more of a number of segments, where each segment can have one or more of a number of dimensions. Examples of such dimensions can include, but are not limited to, size (e.g., diameter) of the wellbore 120, a curvature of the wellbore 120, a total vertical depth of the wellbore 120, a measured depth of the wellbore 120, and a horizontal displacement of the wellbore 120. The field equipment 130 used to create the wellbore 120 can be positioned and/or assembled at the surface 102. The field equipment 130 can include, but is not limited to, a derrick, a tool pusher, a clamp, a tong, drill pipe, a drill bit, and casing pipe. The field equipment 130 can also include one or more devices that measure and/or control various aspects (e.g., direction of wellbore 120, pressure, temperature) of a field operation associated with the wellbore 120. For example, the field equipment 130 can include a wireline tool that is run through the wellbore 120 to provide detailed information (e.g., curvature, azimuth, inclination) throughout the wellbore 120. Such information can dictate how much a casing pipe should be bent for a portion of the wellbore 120 having a high degree of curvature, as described below.

Figure 2:
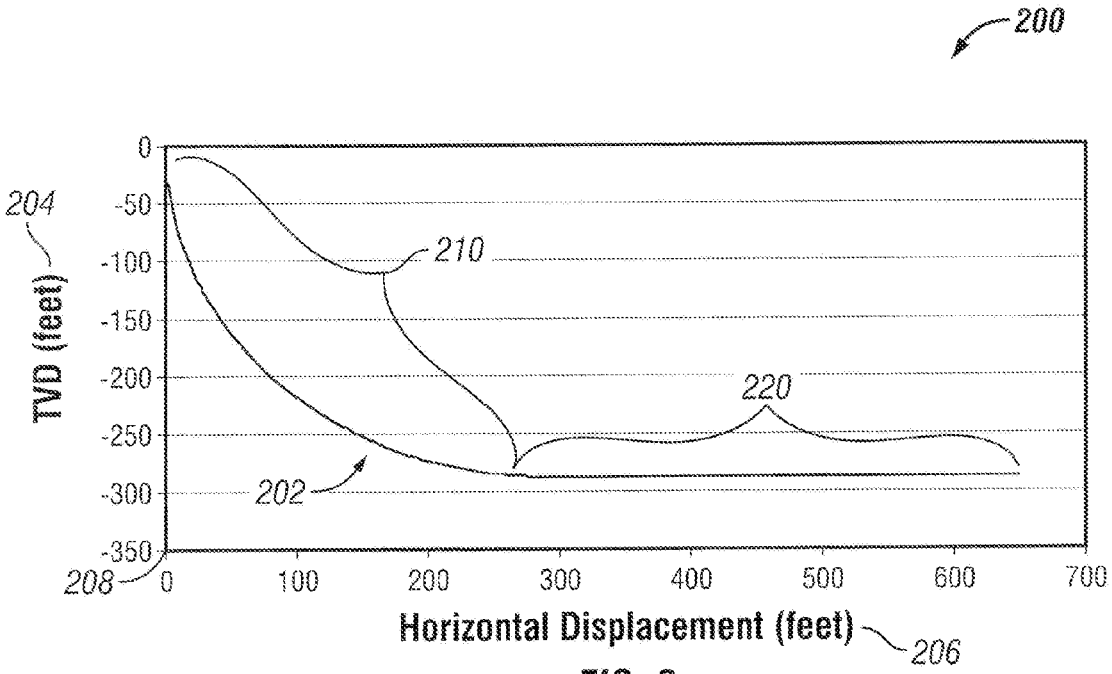
FIG. 2 shows a graph of a wellbore in a subterranean field.

FIG. 2 shows a graph 200 of a wellbore 202 in a subterranean field. The graph 200 shows total vertical depth 204 (TVD) along the vertical axis and horizontal displacement 206 of the wellbore 202 along the horizontal axis. The TVD 204 and the horizontal displacement 206 of the wellbore 202 is with respect to an entry point 208 of the wellbore 202. In this case, the entry point 208 corresponds to the coordinate (0,0) on the graph 200. Both the TVD 204 and the horizontal displacement 206 are shown in terms of feet. The wellbore 202 shown in FIG. 2 is associated with a horizontal well. Specifically, the initial section 210 of the wellbore 202 has a substantially constant curvature to form an approximate quarter circle. The initial section 210 of the wellbore 202 is followed by a horizontal section 220 that has a substantially constant TVD along the remainder of the horizontal displacement 206. In certain embodiments, the horizontal section 220 also has little or no wellbore curvature. If the horizontal section 220 has a wellbore curvature, such wellbore curvature is less severe (e.g., less than 2°) than the wellbore curvature of the initial section 210.

Table 1 below shows the data points used for plotting the initial section 210 of the wellbore 202 shown in the graph 200 of FIG. 2. The column labeled "angle" is a measure, in degrees, of the downward direction of the wellbore 202 at that particular point relative to a downward vertical line. The column labeled "measured depth" describes, in feet, the total length of the wellbore 202 from the entry point 208 (in this case, the coordinate (0,0) on the graph 200). The column labeled "vertical depth" describes, in feet, the vertical component of the wellbore 202 at a certain point in the wellbore 202 relative to the entry point 208. In other words, the "vertical depth" corresponds to the y-coordinate of the wellbore 202 on the graph 200. The column labeled "horizontal displacement" describes, in feet, the horizontal component of the wellbore 202 at a certain point in the wellbore 202 to the entry point 208. In other words, the "horizontal depth" corresponds to the x-coordinate of the wellbore 202 on the graph 200. In this case, the wellbore 202 is a relatively shallow well that has a maximum TVD of approximately 287 feet. The TVD of the horizontal section 220 remains at substantially 287 feet. As Table 1 shows, the angle of curvature increases by approximately 8° for every 40 feet of measured depth along the initial section 210 of the wellbore 202.

TABLE 1

| ANGLE | MEASURED DEPTH (feet) | VERTICAL DEPTH (feet) | HORIZONTAL DEVIATION (feet) |
|---|---|---|---|
| 0 | 0.0 | 0.00 | 0.00 |
| 1 | 5.0 | 5.00 | 0.04 |
| 2 | 10.0 | 10.00 | 0.17 |
| 3 | 15.0 | 14.99 | 0.39 |
| 4 | 20.0 | 19.99 | 0.70 |
| 5 | 25.0 | 24.97 | 1.09 |
| 6 | 30.0 | 29.95 | 1.57 |
| 7 | 35.0 | 34.92 | 2.14 |
| 8 | 40.0 | 39.87 | 2.79 |
| 9 | 45.0 | 44.82 | 3.53 |
| 10 | 50.0 | 49.75 | 4.35 |
| 11 | 55.0 | 54.67 | 5.26 |
| 12 | 60.0 | 59.57 | 6.26 |
| 13 | 65.0 | 64.45 | 7.34 |
| 14 | 70.0 | 69.31 | 8.51 |
| 15 | 75.0 | 74.15 | 9.76 |
| 16 | 80.0 | 78.97 | 11.10 |
| 17 | 85.0 | 83.76 | 12.52 |
| 18 | 90.0 | 88.53 | 14.02 |
| 19 | 95.0 | 93.28 | 15.61 |
| 20 | 100.0 | 97.99 | 17.28 |
| 21 | 105.0 | 102.67 | 19.03 |
| 22 | 110.0 | 107.32 | 20.86 |
| 23 | 115.0 | 111.94 | 22.78 |
| 24 | 120.0 | 116.53 | 24.77 |
| 25 | 125.0 | 121.08 | 26.84 |
| 26 | 130.0 | 125.59 | 29.00 |
| 27 | 135.0 | 130.07 | 31.23 |
| 28 | 140.0 | 134.5 | 33.54 |
| 29 | 145.0 | 138.90 | 35.92 |
| 30 | 150.0 | 143.25 | 38.38 |
| 31 | 155.0 | 147.56 | 40.92 |
| 32 | 160.0 | 151.82 | 43.53 |
| 33 | 165.0 | 156.04 | 46.22 |
| 34 | 170.0 | 160.21 | 48.98 |
| 35 | 175.0 | 164.33 | 51.81 |
| 36 | 180.0 | 168.4 | 54.72 |
| 37 | 185.0 | 172.42 | 57.69 |
| 38 | 190.0 | 176.39 | 60.74 |
| 39 | 195.0 | 180.30 | 63.85 |
| 40 | 200.0 | 184.16 | 67.03 |
| 41 | 205.0 | 187.96 | 70.28 |
| 42 | 210.0 | 191.71 | 73.59 |
| 43 | 215.0 | 195.39 | 76.97 |
| 44 | 220.0 | 199.02 | 80.41 |
| 45 | 225.0 | 202.59 | 83.91 |
| 46 | 230.0 | 206.09 | 87.48 |
| 47 | 235.0 | 209.53 | 91.11 |
| 48 | 240.0 | 212.91 | 94.79 |
| 49 | 245.0 | 216.22 | 98.54 |
| 50 | 250.0 | 219.47 | 102.34 |
| 51 | 255.0 | 222.65 | 106.20 |
| 52 | 260.0 | 225.77 | 110.11 |
| 53 | 265.0 | 228.81 | 114.08 |
| 54 | 270.0 | 231.78 | 118.10 |
| 55 | 275.0 | 234.69 | 122.17 |
| 56 | 280.0 | 237.52 | 126.29 |
| 57 | 285.0 | 240.28 | 130.46 |
| 58 | 290.0 | 242.97 | 134.68 |
| 59 | 295.0 | 245.58 | 138.94 |
| 60 | 300.0 | 248.12 | 143.25 |

TABLE 1-continued

| ANGLE | MEASURED DEPTH (feet) | VERTICAL DEPTH (feet) | HORIZONTAL DEVIATION (feet) |
|---|---|---|---|
| 61 | 305.0 | 250.58 | 147.60 |
| 62 | 310.0 | 252.96 | 152.00 |
| 63 | 315.0 | 255.27 | 156.43 |
| 64 | 320.0 | 257.50 | 160.91 |
| 65 | 325.0 | 259.66 | 165.42 |
| 66 | 330.0 | 261.73 | 169.97 |
| 67 | 335.0 | 263.72 | 174.56 |
| 68 | 340.0 | 265.64 | 179.18 |
| 69 | 345.0 | 267.47 | 183.83 |
| 70 | 350.0 | 269.22 | 188.51 |
| 71 | 355.0 | 270.89 | 193.23 |
| 72 | 360.0 | 272.48 | 197.97 |
| 73 | 365.0 | 273.98 | 202.74 |
| 74 | 370.0 | 275.40 | 207.53 |
| 75 | 375.0 | 276.74 | 212.35 |
| 76 | 380.0 | 277.99 | 217.19 |
| 77 | 385.0 | 279.16 | 222.05 |
| 78 | 390.0 | 280.24 | 226.93 |
| 79 | 395.0 | 281.24 | 231.83 |
| 80 | 400.0 | 282.15 | 236.75 |
| 81 | 405.0 | 282.97 | 241.68 |
| 82 | 410.0 | 283.71 | 246.63 |
| 83 | 415.0 | 284.36 | 251.59 |
| 84 | 420.0 | 284.93 | 256.55 |
| 85 | 425.0 | 285.41 | 261.53 |
| 86 | 430.0 | 285.80 | 266.52 |
| 87 | 435.0 | 286.11 | 271.51 |
| 88 | 440.0 | 286.33 | 276.50 |
| 89 | 445.0 | 286.46 | 281.50 |
| 90 | 450.0 | 286.50 | 286.50 |

Figure 3:
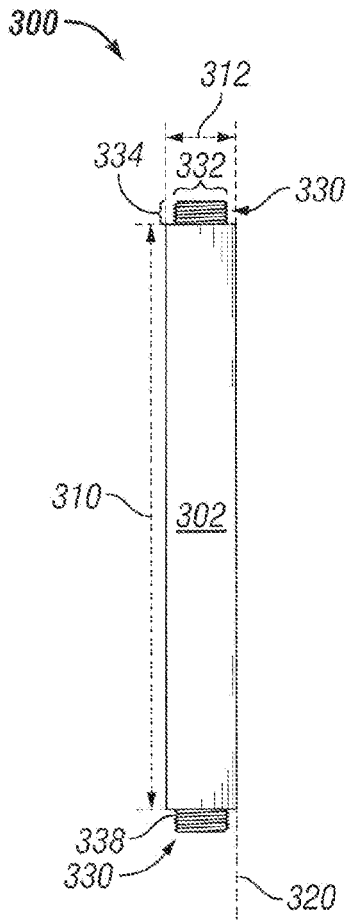
FIG. 3 (Prior Art)
FIG. 3 shows a front view of a casing pipe that is not subject to a side load.

FIG. 3 shows a casing pipe 300 currently used in field operations and that is not subject to a side load. The casing pipe 300 of FIG. 3 has a body 302 that has a length 310 and a width 312. The length 310 of the body 302 of the casing pipe 300 can vary. For example, a common length 310 of the body 302 is approximately 40 feet. The length 310 can be longer (e.g., 60 feet) or shorter (e.g., 10 feet) than 40 feet. The width 312 can also vary and can depend on the cross-sectional shape of the body 302. For example, when the cross-sectional shape of the body 302 is circular, the width 312 can refer to an outer diameter, an inner diameter, or some other form of measurement of the body 302 of the casing pipe 300. Examples of a width 312 in terms of an outer diameter can include, but are not limited to, 7 inches, 7⅝ inches, 8⅝ inches, 10¾ inches, 13⅜ inches, and 14 inches.

In addition, the casing pipe 300 can include a pair of coupling members 330, one disposed at the top of the body 302 and one at the bottom of the body 302. Each coupling member 330 has a length 334 and a width 332. In certain embodiments, the width 332 of a coupling member is substantially the same as an inner diameter of the body 302. In addition, each coupling member 330 has mating threads 338.

The mating threads 338 of the coupling members 330 are oriented in the same manner with respect to each other. For example, the coupling members 330 have right-handed mating threads 338 that are disposed on the outer surface of the coupling members 330. Each of the pair of coupling members 330 can be substantially similar (e.g., length 334, width 332, orientation and sizing of mating threads 338), but be oriented in inverse directions, so that the bottom end of each coupling member 330 is closest to the body 302 and so that the top end of each coupling member 330 is positioned furthest away from the body 302. Each coupling member 330 can form one piece with the body 302 (as from a mold). Alternatively, a coupling member 330 can be mechanically coupled to the body 302 using one or more of a number of coupling techniques, including but not limited to welding, epoxy, mating threads, and compression fittings.

FIG. 3 also shows a vertical line 320 that starts at the upper right portion of the body 302 of the casing pipe 300 and runs downward. Because the casing pipe 300 is oriented in FIG. 3 so that the sides of the body 302 run vertically, FIG. 3 shows that the vertical line 320 is completely aligned with the right side of the body 302 along the entire length of the body 302. In other words, there is no bend in the body 302 of the casing pipe 300 shown in FIG. 3.

Figure 4:
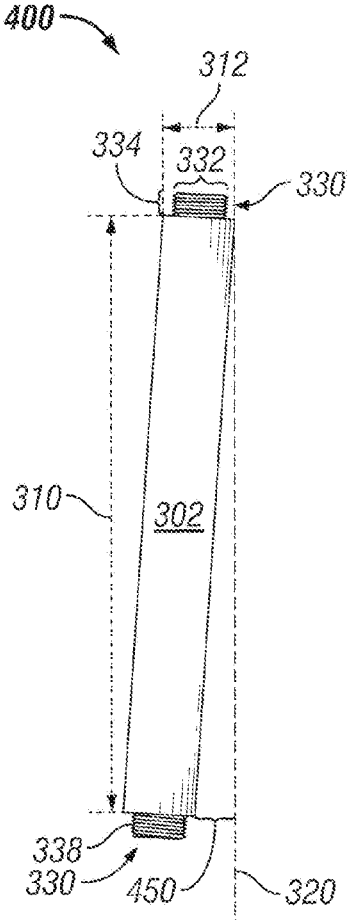
FIG. 4 (Prior Art)
FIG. 4 shows a front view of a casing pipe that is subject to a side load.

Regardless of the length and/or width of the body of a casing pipe, the body has a certain amount of bend that can occur without special treatment or handling of the casing pipe. FIG. 4 shows casing pipe 400, which is substantially the same as casing pipe 300 of FIG. 3, except that it is bent by natural forces (subject to a side load), as when inserted into a substantially straight section of a wellbore. Referring to FIGS. 1-4, the length 310 and width 312 of the body 302 of the example casing pipe 400 are substantially the same as the length 310 and width 312 described above with respect to FIG. 3. However, the vertical line 320 now does not align with the right edge of the body 302 along the length of the casing pipe 400.

For example, if the length 310 of the body 302 of the casing pipe 400 is approximately 40 feet and the width 312 is approximately 9⅝", the maximum displacement 450 (also called deviation) of the bottom right side of the body 302 from the vertical line 320 can be less than 1 foot, which equates to about 2°. Thus, the maximum amount that such a casing pipe 400 can naturally bend or flex (referred to herein as the curvature of the casing pipe 400) is about 2° along its length 310. This poses a problem in wellbores that have a more severe curvature. For example, as Table 1 and the graph 200 of FIG. 2 above show, at a measured depth of 40 feet, the angle of the wellbore 202 is approximately 8°.

As a result, by trying to force the casing pipe 400 into such a wellbore 202, the resulting side load imposed by the walls of the wellbore 202 on the casing pipe 400 would be too high to be overcome by field equipment 130 normally found in a field operation. Even if the field equipment 130 were able to apply enough force to run the casing pipe 400 completely into the subterranean formation 110, the casing pipe 400 would either deviate from the wellbore 202 and/or the body 302 of the casing pipe 400 would become cracked and/or otherwise weakened. In addition, or in the alternative, the coupling device (described below) would be exposed to extremely high stress, jeopardizing the mechanical integrity of the casing pipe assembly.

Figure 5:
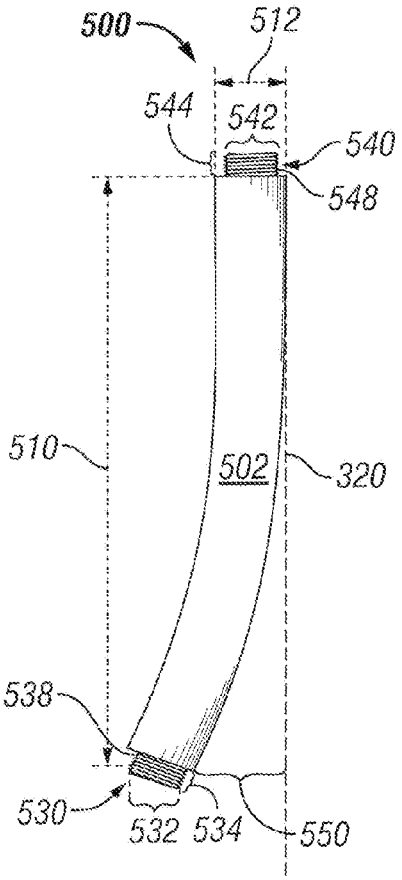
FIG. 5 shows a front view of an example casing pipe that has been bent in accordance with one or more example embodiments.

To solve for this problem, example casing pipe described herein is used. FIG. 5 shows a front view of an example casing pipe 500 that has been bent in accordance with one or more example embodiments. Referring to FIGS. 1-5, in certain example embodiments, the casing pipe 500 includes a body 502 that has a length 510 and a width 512. The length 510 and/or width 512 of the body 502 of the casing pipe 500 can be substantially the same as the length 310 and/or the width 312 of the casing pipe 400 of FIG. 4 above. In this case, however, there are at least two distinct differences between the casing pipe 500 of FIG. 5 and the casing pipe 400 of FIG. 4.

First, the curvature of the casing pipe 500 of FIG. 5 is more severe than the curvature of the casing pipe 400 of FIG. 4. In FIG. 5, the deviation 550 of the of the bottom right side of the body 502 from the vertical line 320 can be greater than the displacement 450 of the bottom right side of the body 302 from the vertical line 320. Specifically, the curvature of the casing pipe 500 can be greater than 2°. As an example, for the wellbore 202 of FIG. 2 and Table 1, the casing pipe 500 having a length 510 of approximately 40 feet can be bent so that the curvature of the body 502 is approximately 8°, which corresponds to approximately 2.5 feet of horizontal displacement 550 of the bottom right side of the body 502 from the vertical line 320.

The body 502 of the casing pipe 500 can be bent using one or more of a number of methods. For example, induction heating can be used to bend the casing pipe 500 to a desired curvature. Such a desired curvature can be obtained from the field equipment 130. Specifically, certain field equipment 130 can be used to obtain detailed information about the wellbore 202, including the size of the wellbore 202 and the curvature of the wellbore 202, in the subterranean formation 110. In certain example embodiments, the curvature of the wellbore 202 is more severe at the initial portion 210 of the wellbore 202 (i.e., closest to the entry point 208) compared to the remaining horizontal section 220 of the wellbore 202.

Once the casing pipe 500 has been bent, the casing pipe 500 can be treated and/or processed in one or more of a number of ways so that the casing pipe 500 is in compliance with any applicable standards, regulations, and/or structural requirements for use as casing pipe in the wellbore 202 of the subterranean formation 110. The casing pipe 500 can be bent at a remote location from the field 100 and associated field operations. Alternatively, the casing pipe 500 can be bent at the field 100.

Another distinct difference between the casing pipe 500 of FIG. 5 and the casing pipe 400 of FIG. 4 is with regard to the coupling members. In certain example embodiments, the casing pipe 500 can have two coupling members that are different from each other, rather than two coupling members 330 that are substantially the same as with the casing pipe 400 of FIG. 4. For example, as shown in FIG. 5, the coupling member 530 disposed at the bottom end of the body 502 is different from the coupling member 540 disposed at the top end of the body 502. Specifically, the threads 538 disposed on the outer surface of the coupling member 530 can run (are oriented) in the opposite direction from the threads 548 disposed on the outer surface of the coupling member 540. In the case of FIG. 5, the threads 538 disposed on the outer surface of the coupling member 530 are left-handed threads, while the threads 548 disposed on the outer surface of the coupling member 540 are right-handed threads.

In certain example embodiments, other characteristics of the coupling member 530 can be substantially the same as corresponding characteristics of the coupling member 540. For example, the length 534 of the coupling member 530 can be substantially the same as the length 544 of the coupling member 540. As another example, the width 532 of the coupling member 530 can be substantially the same as the width 542 of the coupling member 540. The orientation, size, spacing, and/or any other characteristics of the threads 538 and the threads 548 can be set to threadably couple to the threads disposed on the example coupling device, described below with respect to FIG. 7.

Figure 6A:
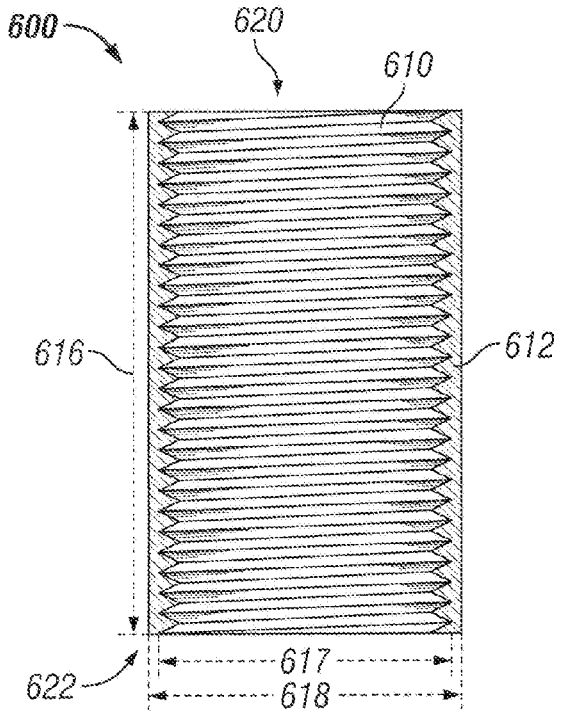
FIG. 6A (Prior Art)
FIGS. 6A and 6B show cross-sectional side views of a coupling device for casing pipe currently known in the art.
Figure 6B:
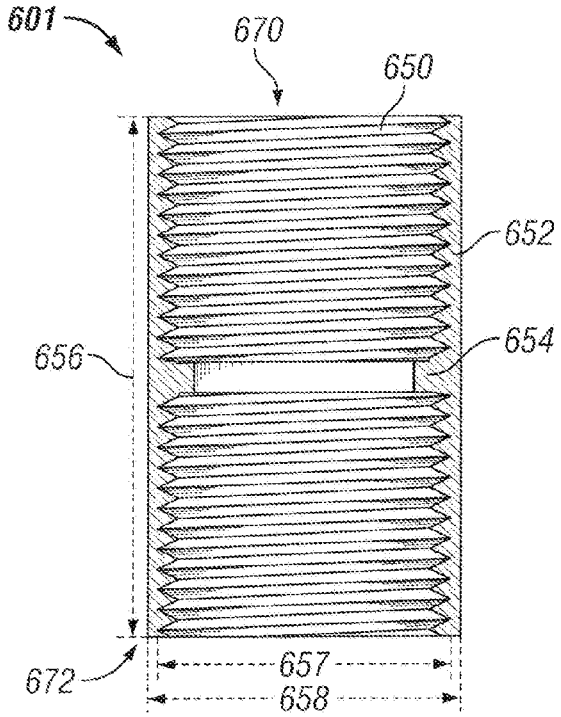
FIG. 6B (Prior Art)

FIGS. 6A and 6B show cross-sectional side views of example coupling devices currently used in field operations. Specifically, FIG. 6A shows a cross-sectional side view of a coupling device 600 having a continuous (linear) wall 612, and FIG. 6B shows a cross-sectional side view of a coupling device 601 having a wall 652 that includes protrusions 654 disposed on its inner surface. The coupling device 600 of FIG. 6A has a length 616, an outer diameter 618, and an inner diameter 617, where the thickness of the wall 612 is the difference between the outer diameter 618 and the inner diameter 617.

In addition, right-handed threads 610 are disposed along the inner surface of the wall 612, particularly along the top end 620 and the bottom end 622 of the coupling device 600. The threads 610 at the bottom end 622 of the coupling device 600 receive a coupling member disposed on a top end of a casing pipe, and the threads 610 at the top end 620 of the coupling device 600 receive a coupling member disposed on a bottom end of a different casing pipe.

The coupling device 601 of FIG. 6B also has a length 656, an outer diameter 658, and an inner diameter 657, where the thickness of the wall 652 is the difference between the outer diameter 658 and the inner diameter 657. Such dimensions of the coupling device 601 can be the same and/or different than the corresponding dimensions of the coupling device 600. In addition, right-handed threads 650 (having the same and/or different characteristics as the threads 610 of the coupling device 600) are disposed along the inner surface of the wall 652, particularly along the top end 670 and the bottom end 672 of the coupling device 601.

Further, one or more protrusions 654 are disposed along the inner surface of the wall 652 approximately half way between the top end 670 and the bottom end 672 of the coupling device 601. Such a protrusion 654 can be used to prevent a casing pipe from being inserted too far through the coupling device 601 through the top end 670 and the bottom end 672. Since the threads 610 in the coupling device 600 and the threads 650 in the coupling device 601 run in the same direction throughout the respective coupling device, the top end and the bottom end of the respective coupling device 600 can be reversed.

Figure 7A:
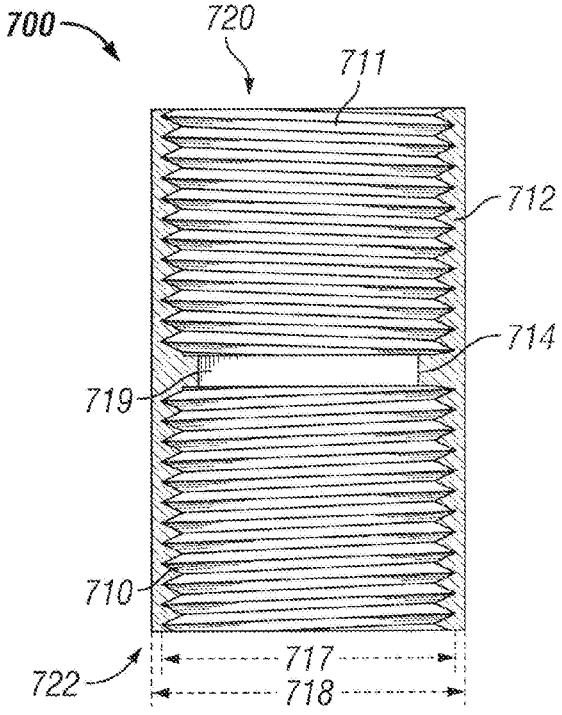
FIGS. 7A and 7B each show a cross-sectional side view of a coupling device in accordance with one or more example embodiments.
Figure 7B:
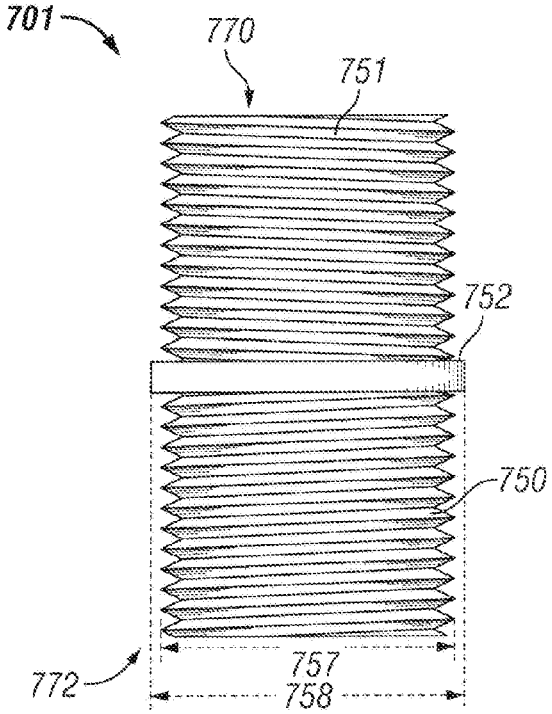

FIGS. 7A and 7B each show a cross-sectional side of view of a coupling device 700 in accordance with one or more example embodiments. Referring to FIGS. 1-7B, the coupling device 700 shown in FIG. 7A is substantially similar to the coupling device 601 of FIG. 6A in that the coupling device 700 has a length 716, an outer diameter 718, and an inner diameter 717, where the thickness of the wall 712 is the difference between the outer diameter 718 and the inner diameter 717. Further, one or more protrusions 714 are disposed along the inner surface of the wall 712 approximately half way between the top end 720 and the bottom end 722 of the coupling device 700. In addition, right-handed threads 710 are disposed along the inner surface of the wall 712 at the bottom half 722 of the coupling device 700.

The threads 711 disposed along the inner surface of the wall 712 at the top half 720 of the coupling device 700, however, are left-handed threads. In other words, the threads 711 at the top half 720 of the coupling device 700 run in an opposite direction from the threads 710 at the bottom half 722 of the coupling device 700. In certain example embodiments, the threads 711 can be right-handed threads, and the threads 710 can be left-handed threads. A portion 719 of the inner surface of the wall 712 can have no threads. Such a portion 719 can be disposed between, or proximate to, the one or more protrusions 714.

The protrusions 714 can extend inward to a point such that the end of the protrusions 714 are substantially aligned with the inner diameter of the body and/or the inner diameter of a coupling member of a casing pipe that mechanically couples to the coupling device 700. In one or more embodiments, one or more of the features shown in FIG. 7 may be omitted, added, repeated, and/or substituted. Accordingly, embodiments of an example coupling device should not be considered limited to the specific arrangements of components and/or features shown in FIG. 7. For example, the one or more protrusions 714 can be eliminated from a coupling device, as shown with the coupling device 600 of FIG. 6A.

Since the threads 710 at the bottom end 722 of the coupling device 700 run in an opposite direction as the threads 711 at the top end 720 of the coupling device 700, the top end 720 and the bottom end 722 of the coupling device 700 cannot be reversed. In other words, the orientation of the coupling device 700 is critical for the coupling device 700 to mechanically couple to one or a pair of casing pipes. Thus, the coupling device 700 can act as a type of turnbuckle.

FIG. 7B shows a different example coupling device 701. In this case, the threads 751 on the top end 770 and the oppositely-directed threads 750 on the bottom end 772 are disposed on an outer surface of the body rather than along the inner surface of the body 712, as shown in FIG. 7A. The example embodiment of the coupling device 701 shown in FIG. 7B can be used when the threads 548 of the top coupling member 540 of the casing pipe 500 and the threads 538 of the bottom coupling member 530 are disposed along an inner surface of the wall (as opposed to the outer surface, as shown in FIG. 5) of the top coupling member 540 and the bottom coupling member 530, respectively. Example coupling device 701 shown in FIG. 7B also comprises a protrusion 752 having a diameter 758 which is greater than diameter 757. Protrusion 752 can be used to prevent the coupling device 701 from being inserted too far within a casing pipe.

Other embodiments of example coupling devices can also be devised. For example, an example coupling device can have a top end with threads disposed on an inner surface of the wall and a bottom end with oppositely-directed threads disposed on an outer surface of the wall. As another example, an example coupling device can have a top end with threads disposed on an outer surface of the wall and a bottom end with oppositely-directed threads disposed on an inner surface of the wall.

Figure 8A:
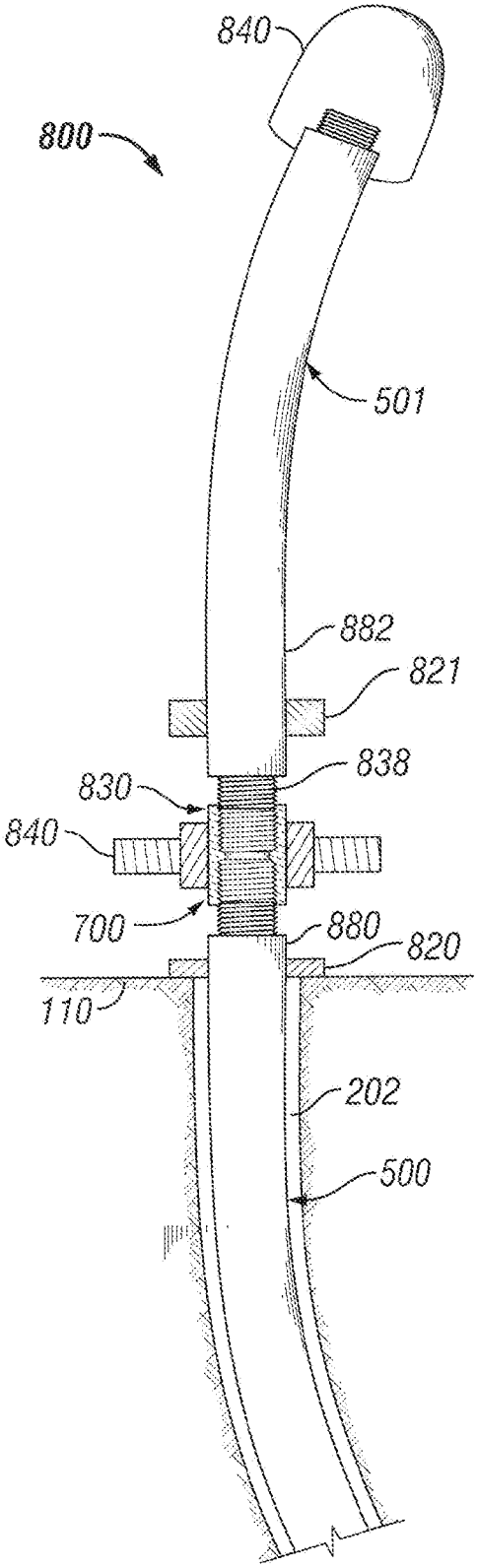
FIGS. 8A and 8B each show a cross-sectional side view of two example bent casing pipes being coupled together using a coupling device in accordance with one or more example embodiments.
Figure 8B:
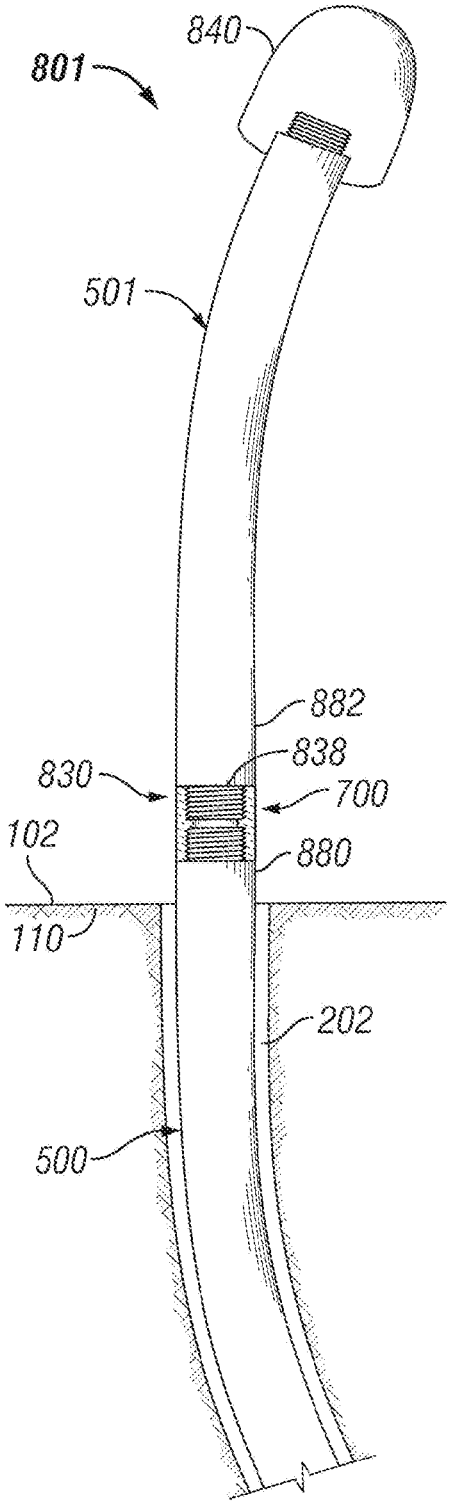

FIGS. 8A and 8B each show a cross-sectional side view of an example where two bent casing pipes are coupled together using a coupling device in accordance with one or more example embodiments. Referring to FIGS. 1-8B, FIG. 8A shows a casing pipe 500 (such as the casing pipe 500 of FIG. 5 above) that has been pushed into part of the initial portion 210 of the wellbore 202 using field equipment 130, such as a tool pusher. The top end of the casing pipe 500 is exposed above the surface 102, while the remainder of the casing pipe 500 is disposed within the wellbore 202.

In this case, the wellbore 202 has a severe curvature (greater than 2°, such as 8° per 40 feet of measured depth). The exact curvature, as shown for example in Table 1 above, can be modeled based on data acquired by field equipment 130. The casing pipe 500 is bent to substantially match the curvature of the initial portion 210 of the wellbore 202. Since the curvature is so severe, the casing pipe 500 is pushed, rather than rotated, into the wellbore 202. If a user tried to rotate the casing pipe 500 into the wellbore 202, the integrity of the wellbore 202 would be compromised, the casing pipe 500 would be damaged, and/or the field equipment 130 used to rotate the casing pipe 500 would be damaged.

The top end of the casing pipe 500 can be held above the surface 102 using one or more of a number of clamping devices 820. For example, as shown in FIG. 8A, an in-hole clamp is wedged between the casing pipe 500 and the entry point 208 of the wellbore 202 to hold the casing pipe 500 in place. By using the clamping device 820, the casing pipe 500 is held stationary and cannot be moved or rotated until the clamping device 820 is removed.

An example coupling device 700, as described above with respect to FIG. 7A, is placed so that the bottom end 722, having threads 710 (e.g., right-handed threads) that match the direction of the threads 548 of the coupling member 540 disposed on the top end of the casing pipe 500, align with the coupling member 540 so that the threads 710 of the coupling device 700 can engage and become threadably coupled to the threads 548 of the coupling member 540 of the casing pipe 500. The coupling device 700 can be held in place by a tong 810, which can mechanically rotate the coupling device 700 axially at the direction of a user.

In addition, an additional casing pipe 501 that is substantially similar (e.g., in terms of curvature, length, width, direction of the threads for the top coupling member and the bottom coupling member) to the casing pipe 500 is positioned above the top end 720 of the coupling device 700. The casing pipe 501 is held in place by other field equipment 130, such as a clamping device 821 mechanically coupled to the bottom end of the casing pipe 501 and a top drive 840 mechanically coupled to the top end of the casing pipe 501. The top drive 840 (or other field equipment 130) can prevent the casing pipe 501 from rotating and position the top end of the casing pipe 501 in such a way that allows the bottom end of the casing pipe 501 to be substantially axially aligned with the coupling device 700 and the top end of the casing pipe 500. The clamping device 821 can also prevent the bottom end of the casing pipe 500 from rotating. The clamping device 821 can be part of the top drive 840.

In certain example embodiments, the bottom coupling member 830 at the bottom end of the casing pipe 501 has left-handed threads 838 (i.e., threads that are oriented in a left-handed direction). Thus, the threads 838 of the bottom coupling member 830 of the casing pipe 501 run in the same direction as the threads 711 disposed on the inner surface of the wall 712 at the top end 720 of the coupling device 700. In addition, the threads 838 of the bottom coupling member 830 of the casing pipe 501 run in the opposite direction as the threads 710 disposed on the inner surface of the wall 712 at the bottom end 722 of the coupling device 700 as well as the threads 548 disposed on the top coupling member 540 of the casing pipe 500.

In certain example embodiments, when the tong 810 rotates the coupling device 700 in a certain direction (in this case, clockwise when looking at the top of the coupling device 700), the coupling device simultaneously couples to the casing pipe 500 and the casing pipe 501. Specifically, as the coupling device 700 rotates in a clockwise direction forced by the tong 810, the threads 710 disposed on the inner surface of the wall 712 at the bottom end 722 of the coupling device 700 become threadably coupled to the corresponding mating threads 548 disposed on the top coupling member 540 at the top end of the casing pipe 500. Since the threads 710 and the threads 548 are oriented in the same direction with respect to each other, the threads mate, and the coupling device 700 mechanically couples to the casing pipe 500 until the top side of the top coupling member 540 abuts against the bottom side of the protrusion 714 disposed within the coupling device 700.

At the same time, as the coupling device 700 rotates in the clockwise direction forced by the tong 810, the threads 711 disposed on the inner surface of the wall 712 at the top end 720 of the coupling device 700 become threadably coupled to the corresponding mating threads 838 disposed on the bottom coupling member 830 at the bottom end of the casing pipe 501. Since the threads 711 and the threads 838 are oriented in the same direction with respect to each other, the threads 711 and the threads 838 mate, and the coupling device 700 mechanically couples to the casing pipe 501 until the bottom side of the bottom coupling member 830 abuts against the top side of the protrusion 714 disposed within the coupling device 700.

When the coupling device 700 mechanically couples to the casing pipe 500 and the casing pipe 501, a casing pipe segment is formed, as shown in FIG. 8B. At this point, the top drive 840 can be used to apply a downward force against the top end of the casing pipe 501 to push the casing pipe segment further into the wellbore 202. In such a case, if the bottom end of the casing pipe 500 is still not at the desired location within the wellbore 202, the process described with respect to FIGS. 8A and 8B can be repeated. In other words, the clamping device 820 can be wedged between the top end of the casing pipe 501 and the walls of the wellbore 202 at the entry point 208 so that another casing pipe can be added by coupling the additional casing pipe and the casing pipe 501 to another coupling device 700.

When the casing pipe segment is formed, the casing pipe 500 and/or the casing pipe 501 can be pulled toward each other (and, more specifically, toward the coupling device 700) because of the turnbuckle action of the coupling device 700. Thus, in certain example embodiments, the clamping device 820, the clamping device 821 and/or the top drive 840 can allow for some degree of vertical movement while the tong 810 operates.

To help ensure proper alignment of the casing pipe 500 and the casing pipe 501 before forming the casing pipe segment, an alignment feature can be disposed on an exterior surface of the body of each casing pipe. An alignment feature can be a marking, an etching, a mechanical feature (e.g., slot, tab), and/or any other feature that can help ensure alignment without affecting the mechanical integrity of the casing pipe. For example, as shown in FIGS. 8A and 8B, an alignment feature 880 is disposed on the outer surface at the top end of the casing pipe 500, and an alignment feature 882 is disposed on the outer surface at the bottom end of the casing pipe 501. In this case, each alignment feature is positioned where the wellbore curvature (and so also the pipe curvature) forms. Example alignment features can be disposed along one or more of a number of various portions (e.g., top end, bottom end, outer wall surface, inner wall surface, coupling member) of a casing pipe. In certain example embodiments, in addition or in the alternative, one or more alignment features can be disposed on the coupling device 700.

Figure 9:
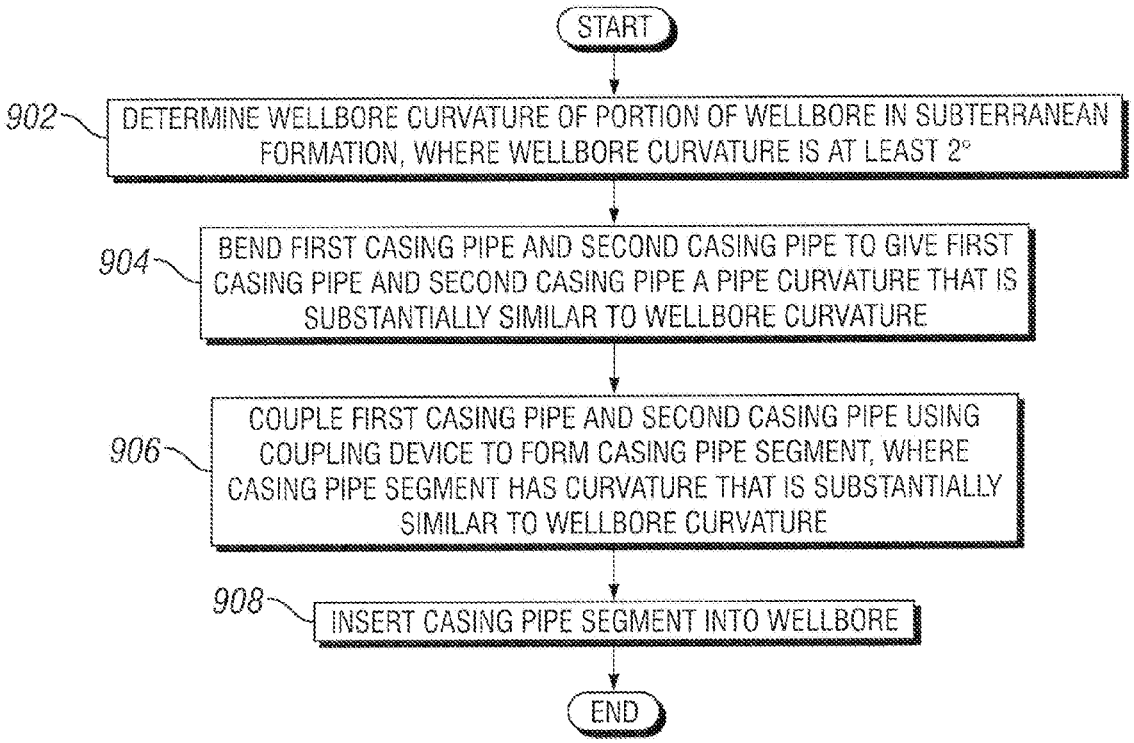
FIG. 9 shows a flow diagram for a method of setting casing pipe in accordance with one or more example embodiments.

FIG. 9 shows a flow diagram for a method 900 of setting casing pipe in accordance with one or more example embodiments. While the various steps in this flowchart are presented and described sequentially, one of ordinary skill will appreciate that some or all of the steps may be executed in different orders, may be combined or omitted, and some or all of the steps may be executed in parallel. Further, in certain example embodiments, one or more of the steps described below may be omitted, repeated, and/or performed in a different order. In addition, a person of ordinary skill in the art will appreciate that additional steps, omitted in FIG. 9, may be included in performing these methods. Accordingly, the specific arrangement of steps shown in FIG. 9 should not be construed as limiting the scope.

Referring now to FIGS. 1-9, the example method 900 begins at the START step and continues to step 902. In step 902, a wellbore curvature of a portion of a wellbore 202 in a subterranean formation 110 is determined. In certain example embodiments, the wellbore curvature is at least 2°.

The wellbore curvature can be determined by one or more components of a field system 130.

In step 904, a first casing pipe 500 and a second casing pipe 501 are each bent to give the first casing pipe 500 and the second casing pipe 501 a pipe curvature that is substantially similar to the wellbore curvature. The first casing pipe 500 and the second casing pipe 501 can be bent using induction heating. Further, the first casing pipe 500 and the second casing pipe 501 can be treated after being bent to comply with one or more of a number of applicable standards and/or regulations.

In step 906, a top coupling member 540 of the first casing pipe 500 is coupled to a bottom coupling member 830 of the second casing pipe 501. The coupling of the first casing pipe 500 and the second casing pipe 501 can be performed using a coupling device 700. The coupling of the first casing pipe 500, the second casing pipe 501, and coupling device 700 can form a casing pipe segment, which can have a curvature that is substantially similar to and aligns with the wellbore curvature. Using the coupling device 700 to mechanically couple the first casing pipe 500 and the second casing pipe 501 can occur in one or more of a number of ways.

For example, the first casing pipe 500 can be inserted into the wellbore 202 in an orientation that aligns the pipe curvature with the wellbore curvature. Then, the top coupling member 540 of the first casing pipe 500 can be secured above a surface 102 while a remainder of the first casing pipe 500 is positioned in the wellbore 202. The first casing pipe 500 can be secured in such a position within the wellbore 202 and above the surface 102 using a clamping device 820. Subsequently, the coupling device 700 can be aligned between the top coupling member 540 of the first casing pipe 500 and the bottom coupling member 830 of the second casing pipe 501.

In such a case, the second casing pipe 501 can be secured in place so that the bottom coupling member 830 of the second casing pipe 501 is axially aligned with the top coupling member 540 of the first casing pipe 500. When held in the correct position for coupling, the pipe curvature of the second casing pipe 501 is aligned with the wellbore curvature. The second casing pipe 501 can be secured using a different clamping device 821 and/or a top drive 840. In certain example embodiments, the clamping device 820 prevents the first casing pipe 500 from rotating, and the clamping device 821 and/or the top drive 840 prevent the second casing pipe 501 from rotating.

Then, the coupling device 700 can be rotated. In certain example embodiments, the coupling device 700 can be rotated by field equipment 130, such as a tong 810. In such a case, the coupling device 700 can have a top end 720 with mating threads 711 that are oriented in one direction and a bottom end 722 with mating threads 710 oriented in the opposite direction from the direction of the mating threads 711. The top coupling member 540 of the first casing pipe 500 can have threads 548 oriented in the same direction as the threads 710 of the bottom end 722 of the coupling device 700, and the bottom coupling member 830 of the second casing pipe 501 can have threads 838 oriented in the same direction as the threads 711 of the top end 720 of the coupling device 700. Thus, the casing pipe segment is formed when the coupling device 700 is rotated and the first casing pipe 500 and second casing pipe 501 are held rotationally still.

When coupling the coupling device 700, the first casing pipe 500, and the second casing pipe 501, the first casing pipe 500 and the second casing pipe 501 are aligned to ensure that the curvature of the casing pipe segment is substantially similar to the wellbore curvature. Such an alignment can occur in one or more of a number of ways. For example, an alignment feature 880 can be disposed on the first casing pipe 500, and a second alignment feature 882 can be disposed on the second casing pipe 501. Prior to coupling the top coupling member 540 of the first casing pipe 500 to the bottom coupling member 830 of the second casing pipe 501, the alignment feature 880 of the first casing pipe 500 is aligned with the alignment feature 882 of the second casing pipe 501.

In step 908, the casing pipe assembly is inserted into the wellbore 202. In certain example embodiments, the casing pipe assembly is inserted into the wellbore 202 by using the top drive 840 to push the casing pipe assembly downward into the wellbore 202. In such a case, there may be no rotational movement of the casing pipe assembly as the casing pipe assembly is inserted into the wellbore 202. In certain example embodiments, when the wellbore curvature is too severe for regular casing pipe, the process can revert to step 906 or, if additional bent casing pipe is needed, to step 902. When the casing pipe segment has been inserted into the portion of the wellbore 202 having the severe wellbore curvature, the method 900 ends at the END step.

The systems, methods, and apparatuses described herein allow for curved casing pipe with timed connections to be inserted into a wellbore. Specifically, casing pipe can be bent or curved to match a curvature of a wellbore in a subterranean formation. At times the curvature of the wellbore can be at least 2° or some other angle that exceeds the amount of flex that a casing pipe being inserted into the wellbore can bend. Thus, example embodiments allow for inserting casing pipe into such wellbores.

Example casing pipe is bent to create a pipe curvature that substantially matches the curvature of the wellbore. Optional alignment features can be disposed on each example casing pipe to help ensure proper alignment when casing pipes are mechanically coupled to each other. In addition, to being bent, one of the coupling mechanisms of each casing pipe has threads (or other applicable coupling feature) that are oriented in an opposite direction from the threads of the other coupling feature of the casing pipe.

Example coupling devices are used to mechanically couple two casing pipes together. A coupling device has threads (or other applicable coupling features) at a top end and at a bottom end of the coupling device. The threads at the top end of the coupling device are oriented in the same direction as the threads disposed on the bottom coupling mechanism of a casing pipe, while the threads at the bottom end of the coupling device are oriented in the same direction as the threads disposed on the top coupling mechanism of another casing pipe. Thus, when the coupling device is positioned between two casing pipes, the casing pipes become simultaneously threadably coupled to the coupling device by rotating the coupling device while the casing pipes are held rotationally in place. The resulting casing pipe segment can be pushed further into a wellbore by applying a force at the top of the casing pipe segment.

Example embodiments can be used in shallow wellbores, horizontal wellbores, and/or wellbores with severe curvature. Thus, example embodiments allow for placement of casing pipe in a wider variety of wellbores, reducing costs and improving efficiency.

Although embodiments described herein are made with reference to example embodiments, it should be appreciated by those skilled in the art that various modifications are well within the scope and spirit of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. A casing pipe assembly, comprising:

a first casing pipe comprising a first body and a first top coupling member disposed on a top end of the first body, wherein the first body has a pipe curvature, wherein the first top coupling member comprises first threads oriented in a first direction, and wherein the pipe curvature substantially corresponds to a wellbore curvature of a portion of a wellbore in a subterranean formation;

a second casing pipe comprising a second body and a first bottom coupling member disposed on a bottom end of the second body, wherein the second body has substantially the pipe curvature, and wherein the first bottom coupling member comprises second threads oriented in a second direction; and a first coupling device comprising a bottom end and a top end, wherein the bottom end of the first coupling device comprises third threads oriented in the first direction and that threadably couple to the first threads of the first top coupling member of the first casing pipe, and wherein the top end of the first coupling device comprises fourth threads oriented in the second direction and that threadably couple to the second threads of the first bottom coupling member of the second casing pipe.

2. The casing pipe assembly of claim 1, further comprising:

a third casing pipe comprising a third body and a second bottom coupling member disposed on a bottom end of a third body, wherein the third body has substantially the pipe curvature, wherein the second bottom coupling member comprises fifth threads oriented in the second direction; and a second coupling device comprising a bottom coupling member and a top coupling member, wherein the bottom coupling member of the second coupling device comprises sixth threads oriented in the first direction and that threadably couple to seventh threads of a second top coupling member of the second casing pipe, and wherein the top coupling member of the second coupling device comprises eighth threads oriented in the second direction and that threadably couple to the fifth threads of the bottom coupling member of the third casing pipe.

3. The casing pipe assembly of claim 1, wherein the first threads and the second threads are oriented in an opposite turning direction from each other.

4. The casing pipe assembly of claim 1, wherein first coupling device comprises a protrusion that limits the first top coupling member and the first bottom coupling member.

5. The casing pipe assembly of claim 1, wherein the pipe curvature of the first casing pipe is greater than 2°.

6. The casing pipe assembly of claim 1, wherein the first casing pipe is approximately 40 feet in length.

7. The casing pipe assembly of claim 1, wherein first casing pipe has an outer diameter of at least 9 inches.

8. A field system, comprising:

a wellbore disposed in a subterranean formation, wherein the wellbore has a wellbore curvature;

a first casing pipe comprising a top coupling member and a pipe curvature, wherein the top coupling member of the first casing pipe comprises first threads oriented in a first direction, and wherein the pipe curvature substantially corresponds to a wellbore curvature of a portion of a wellbore in a subterranean formation;

a first clamping device that mechanically and removably couples to the first casing pipe while a portion of the first casing pipe is disposed within the wellbore and a remainder of the first casing pipe is disposed outside the wellbore;

a second casing pipe comprising a bottom coupling member and substantially the pipe curvature, wherein the bottom coupling member of the second casing pipe comprises second threads oriented in a second direction;

a second clamping device that mechanically and removably couples to the second casing pipe while the second casing pipe is disposed outside the wellbore;

a coupling device comprising a bottom coupling member and a top coupling member, wherein the bottom coupling member of the coupling device comprises third threads oriented in the first direction and that threadably couple to the first threads of the top coupling member of the first casing pipe, and wherein the top coupling member of the coupling device comprises fourth threads oriented in the second direction and that threadably couple to the second threads of the bottom coupling member of the second casing pipe; and a tong that mechanically and removably couples to the coupling device, wherein the tong axially rotates the coupling device.

9. The field system of claim 8, wherein the first clamping device holds the first casing pipe in a first stationary position when the first clamping device is mechanically coupled to the first casing pipe, and wherein the second clamping device holds the second casing pipe in a second stationary position when the second clamping device is mechanically coupled to the second casing pipe.

10. The field system of claim 8, further comprising:

a top drive that mechanically and removably couples to a top coupling member of the second casing pipe to align the second casing pipe with the first casing pipe and the coupling device, wherein the top drive pushes the remainder of the first pipe casing, the coupling feature, and at least a portion of the second casing pipe into the wellbore.

11. The field system of claim 10, wherein the second clamping device is part of the top drive.

12. The field system of claim 8, wherein the wellbore curvature exists in a segment of the wellbore closest to an opening of the wellbore.

13. The field system of claim 12, wherein the wellbore curvature is substantially constant within the segment of the wellbore.

14. The field system of claim 8, wherein a bottom coupling member of the first casing pipe is disposed within the wellbore at substantially a location in the wellbore where the segment of the wellbore ends, after which location the wellbore has a less severe wellbore curvature.

15. A casing pipe comprising:

a body having a length, wherein at least a portion of the length of the body has a pipe curvature, and wherein the body has a cross-sectional shape that is circular along the length of the body;

a first coupling member disposed on a first end of the body, wherein the first coupling member comprises first threads oriented in a first direction, wherein the first coupling member is configured to couple to a first coupling device comprising second threads oriented in the first direction; and a second coupling member disposed on a second end of the body opposite the first end of the body, wherein the second coupling member comprises third threads oriented in a second direction, wherein the second direction is opposite the first direction, wherein the pipe curvature is created to be substantially equal to a wellbore curvature of a portion of a wellbore drilled in a subterranean formation, wherein the body is configured to be inserted into the portion of the wellbore, wherein the pipe curvature substantially reduces a side load on the body as the body is inserted into the wellbore, and wherein the pipe curvature is at least 2°.

16. The casing pipe of claim 15, wherein the first coupling device comprises a first end and an opposing second end, wherein the first end of the first coupling device comprises the second threads oriented in the first direction, and wherein the second end of the first coupling device comprises fourth threads oriented in the second direction.

17. The casing pipe of claim 16, further comprising:

a second coupling member disposed on a second end of the body, wherein the second coupling member comprises fourth threads oriented in the second direction, wherein the third threads of the second coupling member are configured to couple to the fourth threads of the second coupling member.

18. The casing pipe of claim 15, wherein the first coupling member has a first width that is less than a second width of the body.

19. The casing pipe of claim 15, wherein the first threads have a substantially similar diameter along a height of the first coupling member.

* * * * *